US006233948B1

(12) United States Patent
Morishita et al.

(10) Patent No.: US 6,233,948 B1
(45) Date of Patent: May 22, 2001

(54) CONTROL APPARATUS FOR A PLURALITY OF CRYOPUMPS

(75) Inventors: Hiroyuki Morishita; Satoru Uosaki, both of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/504,385

(22) Filed: Feb. 15, 2000

(30) Foreign Application Priority Data

Sep. 29, 1999 (JP) ..... 11-276463

(51) Int. Cl.[7] ..... B01D 8/00
(52) U.S. Cl. ..... 62/55.5; 417/901
(58) Field of Search ..... 62/55.5; 417/901

(56) References Cited

U.S. PATENT DOCUMENTS 4,966,016 * 10/1990 Bartlett ..... 62/55.5
5,010,737 * 4/1991 Okumura et al. ..... 62/55.5
5,157,928 10/1992 Gaudet et al. ..... 62/55.5
5,375,424 * 12/1994 Bartlett et al. ..... 62/55.5
5,443,548 * 8/1995 Saho et al. ..... 62/55.5

FOREIGN PATENT DOCUMENTS

B2-2873031 1/1999 (JP) .

* cited by examiner

*Primary Examiner*—Ronald Capossela
(74) *Attorney, Agent, or Firm*—Birch, Stewart, Kolasch & Birch, LLP

(57) ABSTRACT

For simultaneously controlling a plurality of cryopumps, one processor and communication conversion sections of the respective cryopumps are connected to each other with a communication network. The processor and a host computer are connected to each other with an exclusive line. The processor controls the cryopumps in time division by performing data exchange with the communication conversion sections of the cryopumps by means of packet exchange, line exchange and the like via the communication network. Thus, the need of providing exclusive processors for the cryopumps, respectively, is eliminated, allowing a large extent of cost reduction as well as a wiring simplification to be realized.

6 Claims, 6 Drawing Sheets

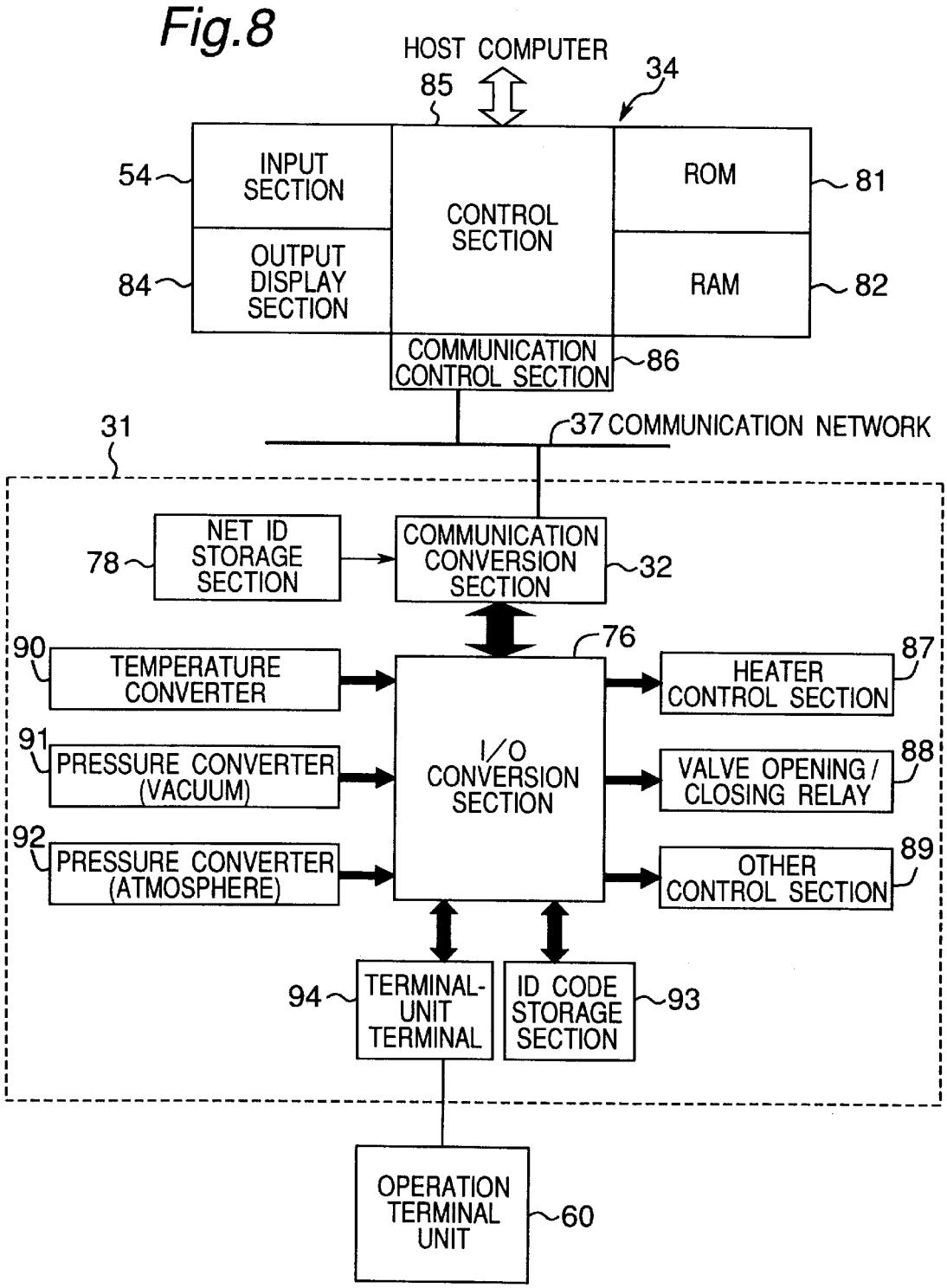
Fig.8
HOST COMPUTER
85
34
54
INPUT SECTION
CONTROL SECTION
ROM
81
84
OUTPUT DISPLAY SECTION
RAM
82
COMMUNICATION CONTROL SECTION
86
31
37 COMMUNICATION NETWORK
78
NET ID STORAGE SECTION
COMMUNICATION CONVERSION SECTION
32
76
90
TEMPERATURE CONVERTER
87
HEATER CONTROL SECTION
91
PRESSURE CONVERTER (VACUUM)
I/O CONVERSION SECTION
88
VALVE OPENING / CLOSING RELAY
92
PRESSURE CONVERTER (ATMOSPHERE)
89
OTHER CONTROL SECTION
94
TERMINAL-UNIT TERMINAL
ID CODE STORAGE SECTION
93
OPERATION TERMINAL UNIT
60

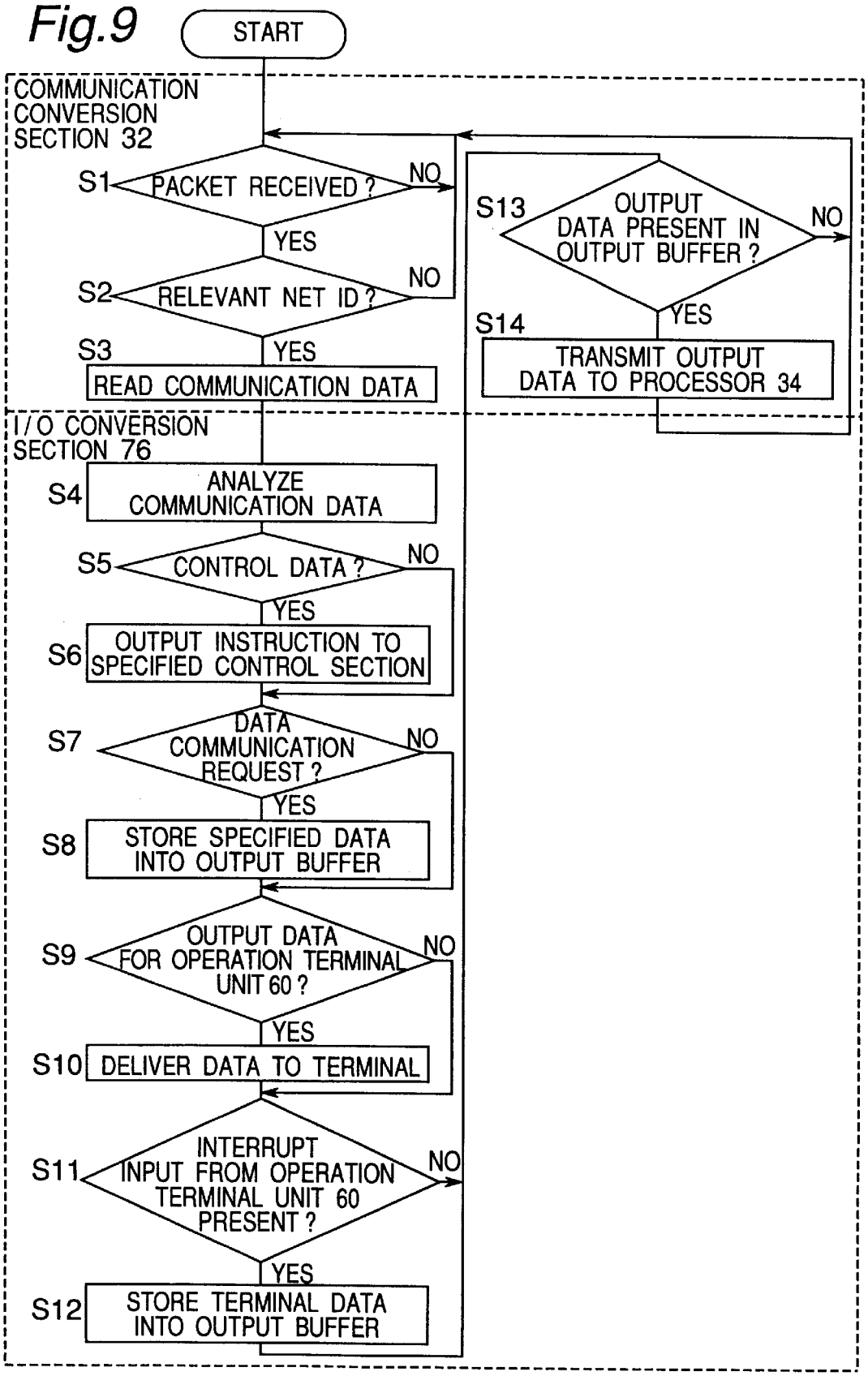
Fig.9
START
COMMUNICATION CONVERSION SECTION 32
S1
PACKET RECEIVED ?
NO
YES
S2
RELEVANT NET ID ?
NO
YES
S3
READ COMMUNICATION DATA
S13
OUTPUT DATA PRESENT IN OUTPUT BUFFER ?
NO
YES
S14
TRANSMIT OUTPUT DATA TO PROCESSOR 34
I/O CONVERSION SECTION 76
S4
ANALYZE COMMUNICATION DATA
S5
CONTROL DATA ?
NO
YES
S6
OUTPUT INSTRUCTION TO SPECIFIED CONTROL SECTION
S7
DATA COMMUNICATION REQUEST ?
NO
YES
S8
STORE SPECIFIED DATA INTO OUTPUT BUFFER
S9
OUTPUT DATA FOR OPERATION TERMINAL UNIT 60 ?
NO
YES
S10
DELIVER DATA TO TERMINAL
S11
INTERRUPT INPUT FROM OPERATION TERMINAL UNIT 60 PRESENT ?
NO
YES
S12
STORE TERMINAL DATA INTO OUTPUT BUFFER

CONTROL APPARATUS FOR A PLURALITY OF CRYOPUMPS

BACKGROUND OF THE INVENTION

The present invention relates to a cryopump control apparatus for controlling a plurality of cryopumps.

Conventionally, cryopumps have been used for evacuation of the interior of a vacuum chamber in semiconductor manufacturing systems or the like. A cryopump of this type is made up by, in a two-stage expansion type refrigerator equipped with expansion cylinders of two stages, attaching a first cryo-panel to a first expansion cylinder of the first stage, further attaching a second cryo-panel to a second expansion cylinder of the second stage, closely fitting activated carbon to the inside of the second cryo-panel, and by covering the first and second cryo-panels as a whole with a casing.

With regard to the cryopump having such a makeup, an opening at a front end of the casing is fitted to a discharge port of a vacuum chamber via a gate valve. Then, water vapor within the vacuum chamber is frozen and collected, and discharged, by the first cryo-panel cooled to 50 K–80 K, and nitrogen gas, oxygen gas, argon gas and the like within the vacuum chamber are condensed and discharged by the second cryo-panel cooled to 10 K–20 K, and moreover hydrogen gas within the vacuum chamber is adsorbed and discharged by the activated carbon.

When the first and second cryo-panels are filled with the above accumulated substances such as hydrogen, oxygen and nitrogen, the first and second cryo-panels are increased in temperature and a nitrogen purge valve is opened so that nitrogen is introduced into the casing, by which a regeneration process of discharging the collected and adsorbed substances is carried out. Further, a cooldown process of cooling the first and second cryo-panels to a low temperature of 20 K is carried out.

In this connection, the discharging process, the regeneration process and the cooldown process in the cryopump are fulfilled by controlling, with an exclusive programmable processor (hereinafter, referred to simply as processor), the supply or discharge of high-pressure helium gas with respect to the two-stage expansion type refrigerator from or to a helium compressor, the turn-on and -off of heaters attached to the first and second cryo-panels, the monitoring of detection signals derived from a thermometer, a pressure gauge and a vacuum gauge, and the opening and closing of various valves.

In semiconductor manufacturing factories, when different processes such as sputtering and etching processes are carried out sequentially on semiconductor wafers, for example, a cluster tool in which process chambers for the respective processes are combined together is used. Further, the plurality of chambers are evacuated by independent cryopumps, respectively, thus making it necessary to control the evacuation process, the regeneration process and the cooldown process in the individual cryopumps according to their respective wafer processes and in correlation with one another.

Therefore, in conventional control apparatuses for cryopumps, a plurality of cryopumps are controlled in the following manner. For example, in the case of an electronically controlled cryopump disclosed in Japanese Patent Publication No. 2873031, exclusive processors 2*a*–2*c*are provided for a plurality of cryopumps 1*a*–1*c*, respectively, as shown in FIG. 10. Then, a processor 2*a* for one cryopump 1*a* is connected with an exclusive line 4 to a host computer 3 that controls the whole system. Further, a processor 2*b* for the cryopump 1*b* is connected to the processor 2*a* with an exclusive line 5, while a processor 2*c* for the cryopump 1*c* is connected to the processor 2*b* with an exclusive line 6.

In this arrangement, control instructions from the host computer 3 to all the cryopumps 1*a*–1*c* are transmitted to the processors 2*a*–2*c* of the cryopumps 1*a*–1*c*, respectively. Whereas an instruction, for example, to the processor 2*c* for the cryopump 1*c* is transmitted via the processors 2*a*, 2*b*, this is intended to facilitate the expanded provision of cryopumps, which is essentially nothing more than that an instruction is transmitted from the host computer 3 directly to the processor 2*c*.

However, the above conventional electronically controlled cryopump has the following problems. That is, in the case of simultaneously controlling, for example, three cryopumps 1*a*–1*c*, exclusive processors 2 having the same functions need to be provided for the cryopumps 1*a*–1*c*, respectively. This is wasteful and lead to an increase in cost, as a problem.

Also, in the case where controlling objects per cryopump 1 are one power switch, two motor-operated valves, one valve motor, two heaters, one pressure gauge and one vacuum gauge, the host computer 3 and one cryopump 1 are connected to each other with eight control lines. Therefore, for simultaneous control of three cryopumps 1*a*–1*c*, 24 (=8×3) control lines are wired from the host computer 3, causing a complexity as another problem.

Accordingly, an object of the present invention is to provide a cryopump control apparatus which eliminates the need of providing exclusive processors for individual cryopumps in controlling a plurality of cryopumps, allowing cost reduction and wiring simplification to be achieved.

In order to achieve the object, there is provided a cryopump control apparatus for controlling a plurality of cryopumps, comprising:

- a communication conversion section and an I/O conversion section both of which are provided in each of the plurality of cryopumps;
- a processor for controlling the plurality of cryopumps; and
- a communication network for connecting the processor and the communication conversion sections of the cryopumps to each other, wherein
  - the processor controls the individual cryopumps by performing data exchange with the communication conversion sections of the respective cryopumps via the communication network.

With this constitution, the processor performs data exchange with the communication conversion sections provided in the plurality of cryopumps, respectively, via the communication network, by which the plurality of cryopumps are controlled. In this way, a plurality of cryopumps are controlled by one processor without mounting exclusive processors on the cryopumps, respectively.

In one embodiment of the present invention, the communication network is formed into a hierarchical structure.

With this embodiment, a communication network can be easily built in the case where a plurality of groups of cryopumps are controlled by one processor or where some cryopumps are additionally provided as an expansion.

In one embodiment of the present invention, the apparatus comprises a compressor unit in which a communication conversion section and an I/O conversion section are provided, and which supplies a compressed refrigerant to the individual cryopumps, wherein the communication conversion section of the compressor unit is connected to the communication network.

With this embodiment, the compressor unit for supplying high-pressure refrigerant gas to the plurality of cryopumps is also controlled via the communication network. This makes it possible to eliminate the exclusive line for connecting the processor and the compressor unit with each other.

In one embodiment of the present invention, the communication network is connected to a host computer.

With this embodiment, the control over the processor by the host computer that controls the whole system is also implemented via the communication network, making it possible to eliminate the exclusive line for connecting the host computer and the processor to each other. Also, the cryopumps, the compressor unit and the processor can be connected to the communication network in this order according to the closeness to the host computer, by which the wiring to the cryopumps, the compressor unit and the processor can be further simplified. Moreover, the evacuation system with the cryopumps can be incorporated into the network of the system controlled by the host computer.

In one embodiment of the present invention, the apparatus comprises a terminal-unit terminal provided in each of the cryopumps and connected to the I/O conversion section; and a manual-operation terminal unit connectable to the terminal-unit terminal.

With this embodiment, it becomes possible to operate only a relevant cryopump at occurrence of a malfunction or the like, while directly viewing the operating state of the relevant cryopump, under the control of the processor based on an instruction from the manual-operation terminal unit.

In one embodiment of the present invention, each of the cryopumps has an index code storage section in which an index code of the relevant cryopump has been stored.

With this embodiment, when a cryopump mounted on a specific vacuum chamber is replaced with another cryopump, the contents of the ID code storage section are changed to an ID assigned to the after-replacement cryopump. Thus, it becomes possible to easily solve the problem that the processor cannot discriminate the respective cryopumps because the processor and the individual cryopumps are not directly connected to each other with exclusive lines.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 8 is a detailed block diagram of part of FIG. 7 relating to the communication control of the cryopump and the processor;

FIG. 9 is a flowchart of the cryopump control process performed by the communication conversion section and the I/O conversion section in FIG. 8.

DETAILED DESCRIPTION OF THE PREFERRED EMBODIMENTS

Figure 1:
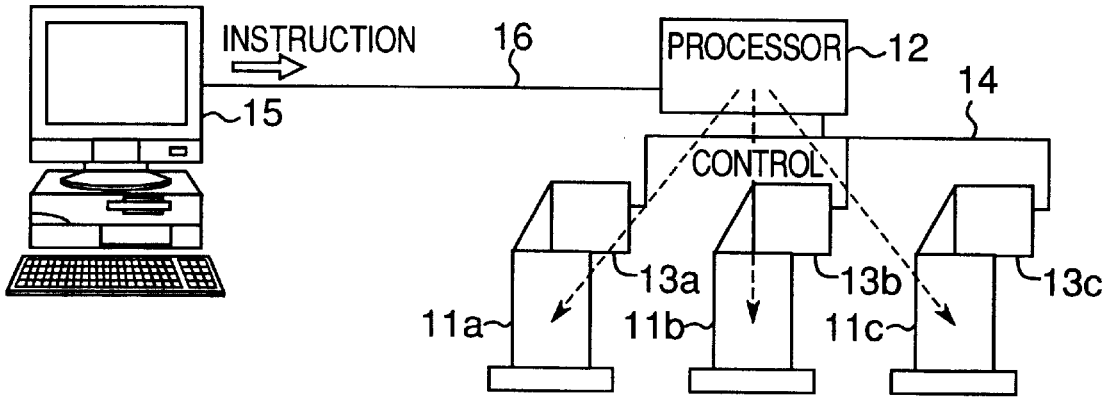
FIG. 1 is a view showing the overall configuration of a cryopump control apparatus according to the invention.

Hereinbelow, the present invention is described in detail by way of embodiments thereof illustrated in the accompanying drawings. FIG. 1 is a view showing the overall configuration of a cryopump control apparatus of this embodiment. In this embodiment, in order to simultaneously controlling a plurality of cryopumps 11*a*–11*c* one processor 12 for controlling all the cryopumps 11*a*–11*c* is provided. The processor 12 is connected to communication conversion sections 13*a*–13*c* of the respective cryopumps 11*a*–11*c* with a communication network 14 comprising, for example, coaxial cables or the like. The processor 12 is further connected to a host computer 15, which controls the whole system, with an RS232C or other exclusive line 16.

The communication network 14, although not particularly limited, is typically a LAN (Local Area Network) using packet communications. In this LAN using packet communications, the processor 12 produces and delivers, to the communication network 14, packets with headers added thereto, each of the headers describing an ID for specifying a location on the communication network 14 for a transmission-destination cryopump 11*a*–11*c* (hereinafter, referred to as net ID) by delimiting into fixed lengths a time series of control data for the cryopumps 11*a*–11*c* based on instructions from the host computer 15.

Then, the communication conversion sections 13*a*–13*c* of the cryopumps 11*a*–11*c* monitor the headers of packets transmitted via the communication network 14, and upon receiving a packet to which a header having a description of the net ID of a relevant cryopump 11 has been added, fetch the packet. After this on, the cryopumps 11 that have fetched packets therein perform the opening and closing of motor-operated valves, the rotation of valve motors and the control of turn-on and -off of heaters in response to a detection signal from a pressure gauge or a vacuum gauge, based on communication data of the fetched packets.

In this way, by transmitting packets to the cryopumps 11*a*–11*c* one after another from the processor 12, the plurality of cryopumps 11*a*–11*c* can be simultaneously controlled by one processor 12.

Figure 2:
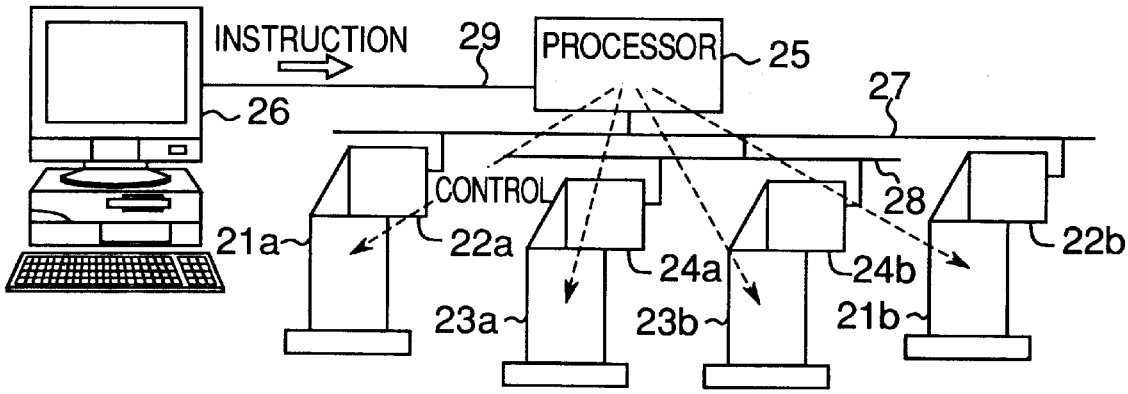
FIG. 2 is a view showing the overall configuration of a cryopump control apparatus in which the communication network is formed into a hierarchical structure.

FIG. 2 shows a modification example in which the communication network is formed into a hierarchical structure. In this case, communication conversion sections 22*a*, 22*b* of cryopumps 21*a*, 21*b* are connected by a communication network 27 to a processor 25 connected by an exclusive line 29 to a host computer 26 which controls the whole system. Further, a communication network 28 to which communication conversion sections 24*a*, 24*b* of cryopumps 23*a*, 23*b* are connected, is connected to the communication network 27. By so doing, for example when a plurality of groups of cryopumps 21, 22 installed in different rooms are controlled by one processor 25, or when some cryopumps are additionally provided, it becomes easier to build a communication network.

Figure 3:
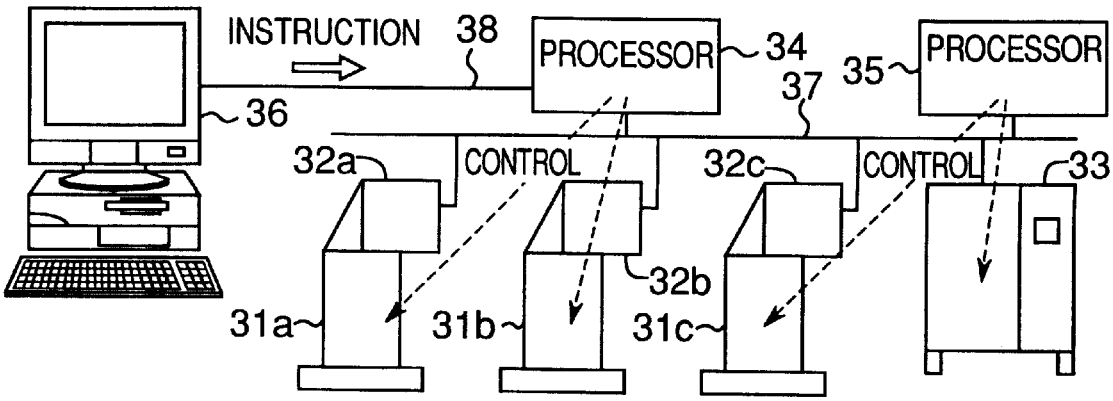
FIG. 3 is a view showing the overall configuration of a cryopump control apparatus in which the compressor unit is also connected onto the communication network.

FIG. 3 shows a modification example in which the compressor unit is also connected onto the communication network. In this case, communication conversion sections 32*a*–32*c* of cryopumps 31*a*–31*c* are connected, by a communication network 37, to a processor 34 connected by an exclusive line 38 to a host computer 36 which controls the whole system. Further, a compressor unit 33 and a processor 35 that controls the compressor unit 33 are connected to the communication network 37. As a result of this, the compressor unit 33 that supplies compressed helium gas to the cryopumps 31*a*–31*c* can also be controlled via the communication network 37, making it possible to eliminate the exclusive line for connecting the processor 34 and the compressor unit 33 to each other.

The processor 35 for controlling the compressor unit 33 connected to the communication network 37 is intended to reduce the control burden on the processor 34, and is not needed when the processor 34 is capable of surplus control burden. In such a case, as shown in FIG. 3, the processor 35 for controlling the compressor unit 33 may be further burdened with the control of part of the cryopumps, the cryopump 31*c*, without any problem.

Figure 4:
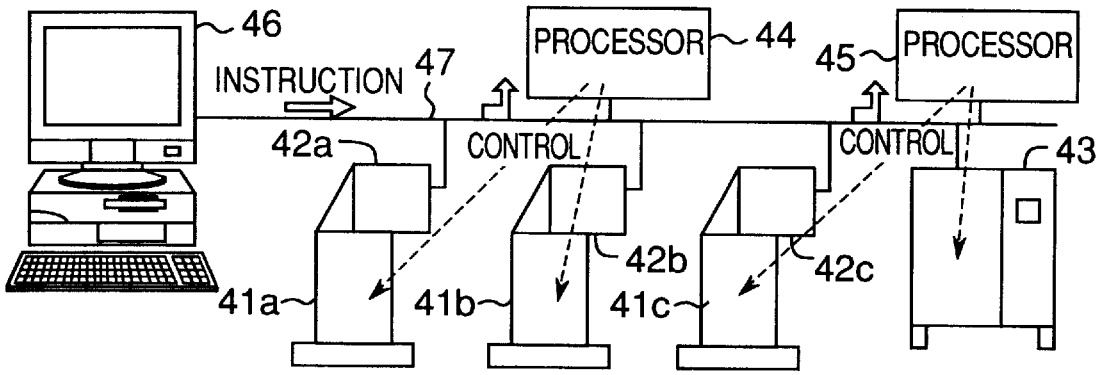
FIG. 4 is a view showing the overall configuration of a cryopump control apparatus in which the host computer is also connected onto the communication network.

FIG. 4 shows a modification example in which a host computer that controls the whole system is also connected onto the communication network. In this case, communication conversion sections 42*a*–42*c* of cryopumps 41*a*–41*c*, a compressor unit 43, a processor 44 and a processor 45 which controls the compressor unit 43 are connected to the host computer 46 by a communication network 47. As a result of this, the control over the processors 44, 45 by the host computer 46 that controls the whole system can also be fulfilled via the communication network 47, making it possible to eliminate the exclusive line for connecting the host computer 46 and the processor 44 to each other. Also, in the case where the cryopumps 41*a*–41*c*, the compressor unit 43 and the processors 44, 45 are connected to the communication network 47, because the cryopumps 41, the compressor unit 43 and the processor 44, 45 can be connected in this order according to the closeness to the host computer 46, wiring can be more simplified. Besides, it becomes possible to incorporate the evacuation system using the cryopumps 41*a*–41*c* into the network of the whole system including the wafer transfer system and the like controlled by the host computer 46.

In this embodiment also, the processor 45 for controlling the compressor unit 43 may be omitted when the processor 44 is capable of surplus control burden. Besides, as shown in FIG. 4, the processor 45 for controlling the compressor unit 43 may be further burdened with the control of part of the cryopumps, the cryopump 41*c*, without any problem.

Figure 5:
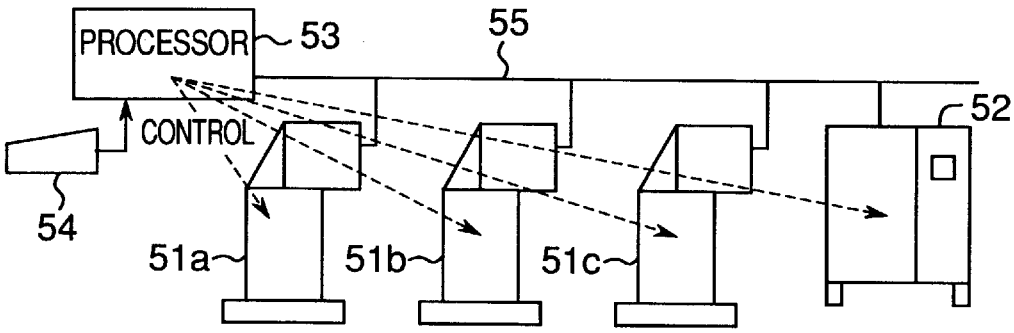
FIG. 5 is a view showing the overall configuration of a cryopump control apparatus in which the cryopumps are manually controlled by manual operation from the processor.
Figure 6:
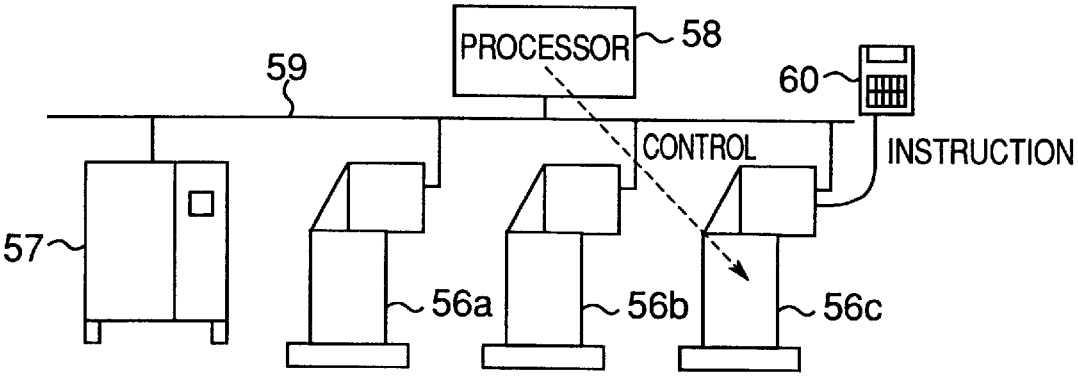
FIG. 6 is a view showing the overall configuration of a cryopump control apparatus in which the cryopumps are operable at hand from an operation terminal unit.

In the cryopump control apparatuses via a communication network having the above-described constitutions, as shown in FIG. 5, an input section 54 such as a keyboard is provided in a processor 53 so that cryopumps 51 and a compressor unit 52 can be manually controlled by manual operation from the input section 54 via a communication network 55. As a result of this, test operation or the like can be easily performed. In the case where the whole system comprises only an evacuation system using the cryopumps 51*a*–51*c*, the constitution of FIG. 5 alone suffices. Accordingly, in that case, the host computer is no longer necessary. Further, as shown in FIG. 6, an operation terminal unit 60 may be connected to cryopumps 56*a*–56*c*, in which case a relevant cryopump 56 and a compressor unit 57 can be operated at hand via a communication network 59 by a processor 58 based on an instruction from the operation terminal unit 60. As a result of this, it becomes possible to operate only a relevant cryopump 56 at occurrence of a malfunction or the like, while directly viewing the operating state of the cryopump 56.

Figure 7:
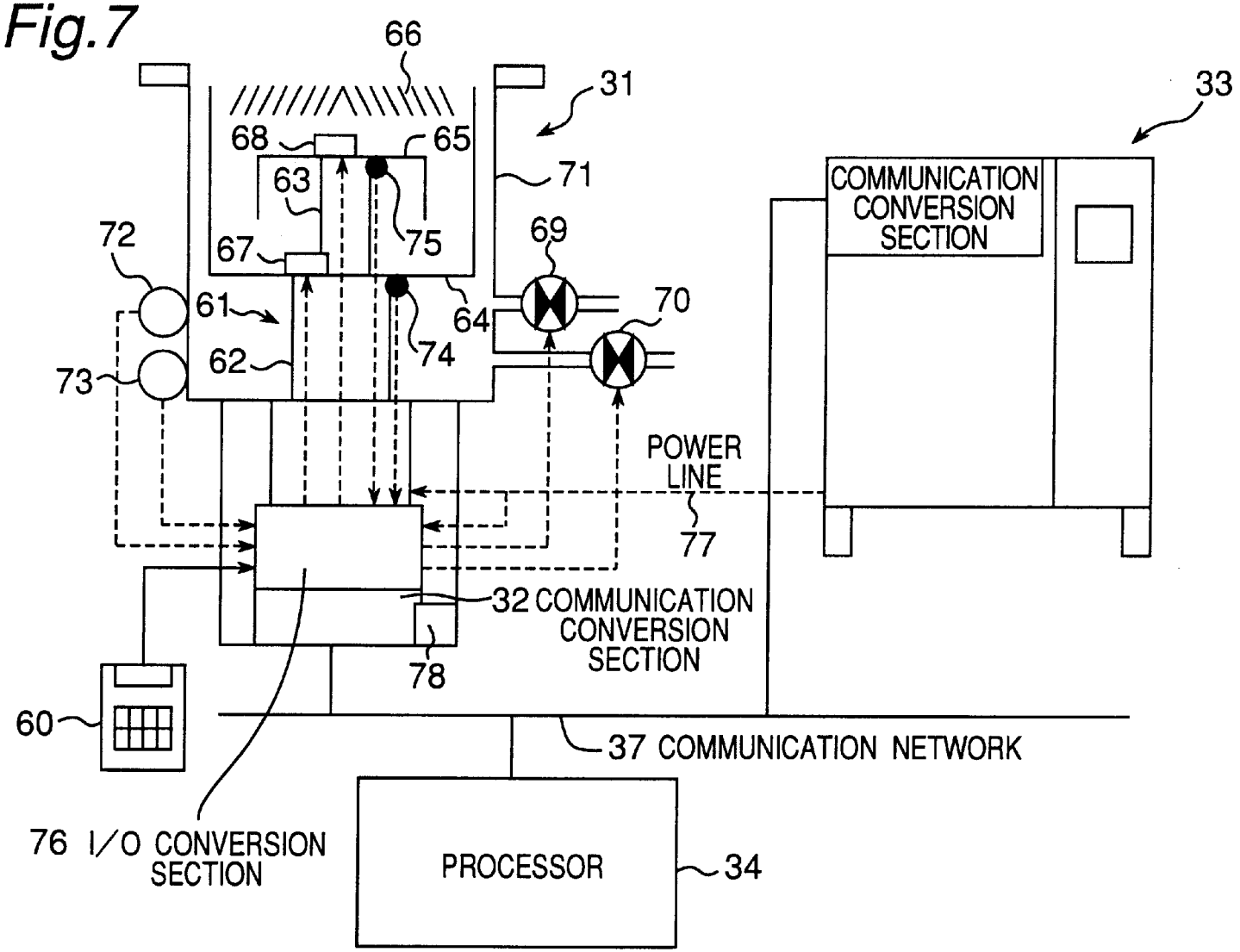
FIG. 7 is a conceptual view showing main part of FIG. 3.
Figure 10:
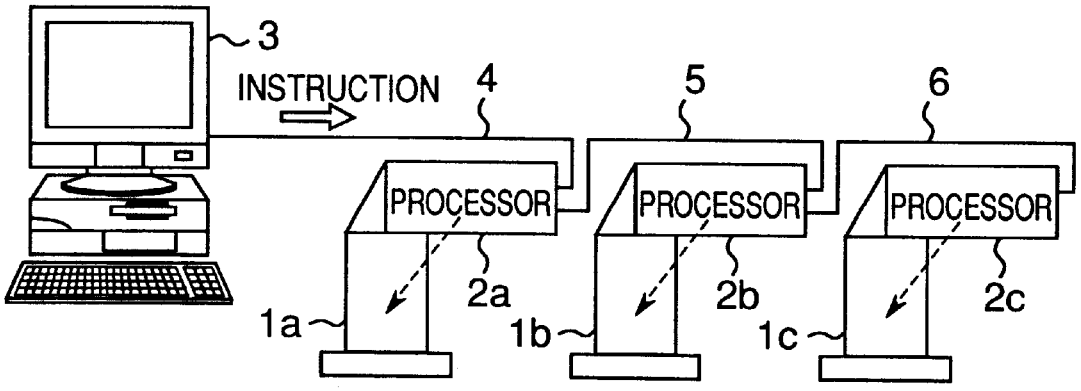
Fig.10 PRIOR ART
FIG. 10 is a view showing the overall configuration of a cryopump control apparatus according to the prior art capable of controlling a plurality of cryopumps.

Now, the construction of a cryopump that enables the simultaneous control of a plurality of cryopumps via a communication network as described above is described below. FIG. 7 shows a conceptual view showing main part of FIG. 3. In FIG. 7, a two-stage expansion type refrigerator 61 comprising expansion cylinders 62, 63 of two stages is used in a cryopump 31.

A first cryo-panel 64 is mounted on a heat stage (first heat stage) in the first expansion cylinder 62 of the first stage. Also, a second cryo-panel 65 is mounted on a heat stage (second heat stage) in the second expansion cylinder 63 of the second stage.

Then, water vapor within the chamber (not shown) is frozen and collected, and discharged, by the first cryo-panel 64 and a baffle 66 attached to a front end of the first cryo-panel 64. Meanwhile, oxygen gas, nitrogen gas, argon gas and the like that cannot be discharged by the first cryo-panel 64 are frozen and collected by the second cryo-panel 65, while hydrogen gas is adsorbed to activated carbon (not shown) closely fitted to the second cryo-panel 65, and then those gases are discharged.

In the first heat stage and the second heat stage, are mounted first, second heaters 67, 68 for evaporating gas molecules that have been frozen and collected by heating the first, second cryo-panels 64, 65 during the regeneration process. Also, an exhaust valve 69 is opened to discharge, out of the cryopump, regenerated gases that have been evaporated or released from the cryo-panels 64, 65 or the activated carbon. A roughing exhaust valve 70 is opened to roughly evacuate the interior of a casing 71 when the regeneration process is ended and succeeded by the cooldown process. A pressure gauge 72 detects the atmospheric pressure and outputs an atmospheric pressure signal. A vacuum gauge 73 detects a vacuum pressure within the casing 71 and outputs a vacuum pressure signal. Thermometers 74, 75 attached to the first, second heat stages detect heat stage temperatures and output temperature signals.

An I/O conversion section 76 receives control data that has been received by the communication conversion section 32 and that have been converted into a processible format, and distributes the data to a control section, a relay or the like depending on control objects as detailed later. Also, when the received communication data is a data request, the I/O conversion section 76 selects one of an atmospheric pressure signal derived from the pressure gauge 72, a vacuum pressure signal derived from the vacuum gauge 73 and temperature signals derived from the thermometers 74, 75 depending on the contents of the request, and then transmits the signal to the communication conversion section 32. Then, the communication conversion section 32 converts the received signal into a signal format suited to propagation, and transmits the signal to the communication network 37.

It is noted here that electric power for the cryopump 31 having the above constitution is supplied from the compressor unit 33 via a power line 77 to a valve motor (not shown) which controls a valve for supplying and discharging compressed helium gas derived from the compressor unit 33 to and from the two-stage expansion type refrigerator 61 during the evacuation process, as well as to the I/O conversion section 76. In addition, reference numeral 78 denotes a net ID storage section in which the net ID of the cryopump 31 has been stored. An I/O conversion section (not shown) is mounted also on the compressor unit 33.

FIG. 8 is a detailed block diagram of part of FIG. 7 relating to the communication control of the cryopump 31 and the processor 34 via the communication network 37. In ROM (Read Only Memory) 81 of the processor 34, are stored operating programs, regeneration programs and cooldown programs corresponding to respective processes by the cryopumps 31*a*–31*c*. In addition, in RAM (Random Access Memory) 82, are stored such records and temporary data as operating conditions and regeneration conditions that can be set from external, operating history and regeneration history of the past as to the individual cryopumps 31*a*–31*c*, and the like. An input section 54, implemented by a keyboard or the like, serves for new registration and update of conditions or the like to the RAM 82. An output section 84, implemented by a display or the like, serves for output of contents of inputs from the input section 54 or the like.

A control section 85, upon receiving an instruction from the host computer, reads out operating programs, regeneration programs or cooldown programs for the cryopumps 31*a*–31*c* from the ROM 81 by looking up to the operating history and regeneration history stored in the RAM 82, and as required, reads out operating conditions and regeneration conditions from the RAM 82 to create control data for the cryopumps 31*a*–31*c*. Then, the control section 85 transmits the created control data to a communication control section 86. The communication control section 86 delimits a time series of the control data into fixed lengths, and adds, to the data, headers having the description of net IDs or the like for specifying a transmission-destination cryopump 31*a*–31*c*, thus preparing packets. Further, the communication control section 86 converts the prepared packets into a signal format suited to propagation via the communication network 37, and outputs the signals to the communication network 37.

The communication conversion section 32 of the cryopump 31 monitors the headers of packets transmitted via the communication network 37 as stated above, and by looking up to the net IDs stored in the net ID storage section 78, fetches packets transmitted to the relevant cryopump 31. Then, the communication conversion section 32 reads out communication data from the packets, converts the data into a processible format, and transmits the data to the I/O conversion section 76.

The I/O conversion section 76 analyzes the received communication data and, when the data is control data for the heaters 67, 68, outputs a command responsive to the control data to a heater control section 87. Also, when the data is control data for the exhaust valve 69 or the roughing exhaust valve 70, the I/O conversion section 76 outputs a command responsive to the control data to a valve opening/closing relay 88. When the data is control data for the valve motor or the like, the I/O conversion section 76 outputs a command responsive to the control data to an other control section 89.

Further, when the data is a transmission request for temperature data of the thermometers 74, 75, the I/O conversion section 76 reads out temperature data responsive to the request derived from a temperature converter 90. When the data is a transmission request for vacuum pressure data, the I/O conversion section 76 reads out vacuum pressure data derived from a vacuum-dedicated pressure converter 91. When the data is a transmission request for atmospheric pressure data, the I/O conversion section 76 reads out atmospheric pressure data derived from an atmosphere-dedicated pressure converter 92. When the data is a transmission request for ID data assigned to the cryopump 31 itself, the I/O conversion section 76 reads out ID code data of the cryopump 31 from an ID code storage section 93. Then, the I/O conversion section 76 transmits the read data to the communication conversion section 32. Subsequently, the communication conversion section 32 prepares packets by adding to each piece of the data a header having the description of the net ID or the like for specifying the processor 34, converts the packets into a signal format suited to propagation via the communication network 37, and outputs the signals to the communication network 37. Although not described in detail, part of the history of the relevant cryopump 31 stored in the RAM 82 is to be written into the ID code storage section 93 via the communication network 37 by the control section 85 of the processor 34. As a result of this, even when the cryopump 31 is disconnected from the processor 34, necessary history of the cryopump 31 can be retained.

Further, in the event of an interrupt input from a terminal-unit terminal 94 originating from the operation terminal unit 60 connected to this terminal-unit terminal 94, the I/O conversion section 76 transmits input data derived from the operation terminal unit 60 to the communication conversion section 32. Otherwise, when the communication data received from the communication conversion section 32 is output data for the operation terminal unit 60, the I/O conversion section 76 outputs the data to the terminal-unit terminal 94.

In the cryopump control apparatus having the above-described constitution, the cryopump 31 operates according to a flowchart shown in FIG. 9 under the control of the communication conversion section 32 and the I/O conversion section 76. As stated before, when the cryopump 31 is powered from the compressor unit 33 via the power line 77 according to an instruction from the processor 34, a cryopump control process operation starts.

At step S1, when a packet is received by the communication conversion section 32 via the communication network 37, the program goes to step S2. At step S2, it is decided whether or not the net ID of the cryopump concerned is described in the header of the received packet. As a result, if the relevant net ID is described, the program goes to step S3. At step S3, communication data of the packet is read and delivered to the I/O conversion section 76. After this on, the program flow moves to processes by the I/O conversion section 76.

It is noted here that the net ID refers to an ID for specifying the location of a cryopump 31 on the communication network 37, being an ID for specifying a cryopump 31 mounted on a specific vacuum chamber. Accordingly, even when a relevant cryopump 31 is replaced with another cryopump 31' because of failure, the net ID remains unchanged. In contrast to this, the ID stored in the ID code storage section 93 is an ID assigned to the relevant cryopump 31 itself. Accordingly, when the cryopump 31 mounted on the specific vacuum chamber is replaced with another cryopump 31' , the ID is changed to an ID assigned to the cryopump 31' . As a result, the records of the cryopump 31 itself such as operating history and regeneration history stored in the RAM 82 of the processor 34 are also set to initial values.

At step S4, the communication data received from the communication conversion section 32 is analyzed by the I/O conversion section 76. At step S5, if the analysis result is control data, the program goes to step S6. At step S6, a command responsive to the control data is outputted to the control section or the relay specified by the control data. At step S7, if the analysis result is a data transmission request, the program goes to step S8. At step S8, data is read out from the converter 90–92 or the ID code storage section 93 specified by the communication data, and transmitted and stored to output buffer contained in the communication conversion section 32.

At step S9, if an analysis result is output data for the operation terminal unit 60, the program goes to step S10. At step S10, the output data is transmitted to the terminal-unit terminal 94. At step S11, it is decided whether or not an interrupt input from the operation terminal unit 60 is present. As a result, if an interrupt input is present, the program goes to step S12; if not, the program skips step S12. At step S12, terminal data derived from the terminal-unit terminal 94 is stored into the output buffer of the communication conversion section 32. After this on, the program moves to the process by the communication conversion section 32.

At step S13, it is decided by the communication conversion section 32 whether or not output data has been stored in the output buffer. As a result, if the output data has been stored, the program goes to step S14; if not, the program returns to step S1, moving to the process for the next received package. At step S14, a packet in which headers having the description of the net ID of the processor 34 are added to the output data is prepared and transmitted to the communication network 37. Subsequently, the program returns to step S1, moving to the process for the next received package.

As described above, in this embodiment, in order to simultaneously control a plurality of cryopumps 11*a*–11*c* as shown in FIG. 1, one processor 12 for controlling the plurality of cryopumps 11*a*–11*c* according to instructions of the host computer 15, and communication conversion sections 13*a*–13*c* of the cryopumps 11*a*–11*c* are connected to each other with the communication network 14. Then, the processor 12 performs data exchange with the communication conversion sections 13*a*–13*c* of the cryopumps 11*a*–11*c* by means of packet exchange, line exchange or the like via the communication network 14 so as to control the cryopumps 11*a*–11*c* in time division.

Therefore, according to this embodiment, the processor 12, expensive in price, has only to be provided one in number in order to simultaneously control a plurality of cryopumps 11*a*–11*c*. That is, there is no need of providing exclusive processors for the individual cryopumps 11*a*–11*c*, respectively, so that a large extent of cost reduction can be achieved. Also, the processor 12 and the individual cryopumps 11*a*–11*c* may be connected to each other by a one-line communication network 14. Therefore, it is no longer necessary to connect the host computer 15 and the individual cryopumps 11*a*–11*c* with exclusive lines, so that the number of lines can be reduced and the wiring can be simplified.

Further, by forming the communication networks 27, 28 into a hierarchical structure as shown in FIG. 2, it becomes easier to build the communication networks in the case where a plurality of groups of cryopumps 21, 23 are controlled by one processor 25, or where some cryopumps are additionally provided. Furthermore, by connecting the compressor unit 33 also onto the communication network 37 as shown in FIG. 3, it becomes possible to control, also via the communication network 37, the compressor unit 33 for supplying compressed helium gas to the cryopumps 31*a*–31*c*.

Therefore, the exclusive line for connecting the processor 34 and the compressor unit 33 to each other can be eliminated. Further, by connecting the host computer 46, which controls the whole system, also onto the communication network 47 as shown in FIG. 4, the exclusive line for connecting the host computer 46 and the processor 44 to each other can be eliminated. Besides, the evacuation system sing the cryopumps 41*a*–41*c* can be included in the network of the system controlled by the host computer 46.

Furthermore, as shown in FIG. 6, the operation terminal unit 60 can be made connectable to the cryopumps 56*a*–56*c*, and a relevant cryopump 56 and the compressor unit can be made operable at hand by the processor 58 via the communication network 59 based on an instruction from the operation terminal unit 60. As a result of this, it becomes possible to operate only the relevant cryopump 56 while directly viewing the operating state of the cryopump 56 at occurrence of a malfunction or the like.

Further, the ID code storage section 93 is provided in each of the cryopumps 31, and an ID code assigned to the relevant cryopump 31 itself is stored therein. Then, when a cryopump 31 mounted on a specific vacuum chamber is replaced with another cryopump 31' , the contents of the ID code storage section 93 are changed to an ID assigned to the cryopump 31' . Further, the records of the after-replacement cryopump 31' such as operating history and regeneration history stored in the RAM 82 of the processor 34 are also set to initial values. Therefore, it becomes possible to easily solve the problem that the processor 34 cannot specify the individual cryopumps 31*a*–31*c* because the processor 34 and the individual cryopumps 31*a*–31*c* are not directly connected to each other with exclusive lines, respectively. As a result, the regeneration process, an overhaul and the like can be carried out on the individual cryopumps 31*a*–31*c* appropriately according to specified plans.

The above embodiment has been described on the assumption that the communication network 37 is a LAN using packet exchange. However, the communication network of the invention is not particularly limited to this but a concept including radio networks and the like. Also, the construction of the cryopump 31 shown in FIG. 7 is no more than a typical example, and actually is equipped with more valves and the like. In those cases, the cryopump 31 is controlled in the same manner. Further, in the above embodiment, although the operating conditions and regeneration conditions, operating history and regeneration history and the like are recorded in the RAM 82, those conditions and histories and the like may be recorded in such external memories as hard disks and memory cards without any problem.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cryopump control apparatus for controlling a plurality of cryopumps, comprising:

a communication conversion section and an I/O conversion section both of which are provided in each of the plurality of cryopumps;

a processor for controlling the plurality of cryopumps; and a communication network for connecting the processor and the communication conversion sections of the cryopumps to each other, wherein the processor controls the individual cryopumps by performing data exchange with the communication conversion sections of the respective cryopumps via the communication network.

2. A cryopump control apparatus according to claim 1, wherein the communication network is formed into a hierarchical structure.

3. A cryopump control apparatus according to claim 1, further comprising:

a compressor unit in which a communication conversion section and an I/O conversion section are provided, and which supplies a compressed refrigerant to the individual cryopumps, wherein the communication conversion section of the compressor unit is connected to the communication network.

4. A cryopump control apparatus according to claim 1, wherein the communication network is connected to a host computer.

5. A cryopump control apparatus according to claim 1, further comprising:

a terminal-unit terminal provided in each of the cryopumps and connected to the I/O conversion section; and a manual-operation terminal unit connectable to the terminal-unit terminal.

6. A cryopump control apparatus according to claim 1, wherein each of the cryopumps has an index code storage section in which an index code of the relevant cryopump has been stored.

* * * * *